US008056492B2

(12) United States Patent
Roodenburg et al.

(10) Patent No.: US 8,056,492 B2
(45) Date of Patent: Nov. 15, 2011

(54) VESSEL COMPRISING A SUBSEA EQUIPMENT MOTION RESTRAINING AND GUIDANCE SYSTEM

(75) Inventors: Joop Roodenburg, Delft (NL); Anne Klaas De Groot, Sugar Land, TX (US); Pieter Dirk Melis Van Duivendijk, Missouri City, TX (US)

(73) Assignee: Itrec B.V., Schiedam (NL)

( * ) Notice: Subject to any disclaimer, the term of this patent is extended or adjusted under 35 U.S.C. 154(b) by 551 days.

(21) Appl. No.: 11/991,140

(22) PCT Filed: Aug. 29, 2005

(86) PCT No.: PCT/NL2005/000623

§ 371 (c)(1),
(2), (4) Date: Mar. 13, 2009

(87) PCT Pub. No.: WO2007/027081

PCT Pub. Date: Mar. 8, 2007

(65) Prior Publication Data

US 2009/0199757 A1 Aug. 13, 2009

(51) Int. Cl.
*B63B 27/16* (2006.01)

(52) U.S. Cl. ..... 114/268; 114/51

(58) Field of Classification Search ..... 114/51, 114/268; 254/270, 277, 286
See application file for complete search history.

(56) References Cited

U.S. PATENT DOCUMENTS

| | | | |
|---|---|---|---|
| 2,874,855 | A | 2/1959 | Rees, Jr. |
| 4,245,578 | A | 1/1981 | Bianco et al. |
| 6,871,609 | B2 | 3/2005 | Roodenburg et al. |
| 2004/0089215 | A1 | 5/2004 | Roodenburg et al. |

FOREIGN PATENT DOCUMENTS

| | | | |
|---|---|---|---|
| EP | 1 103 459 | A1 | 5/2001 |
| GB | 2 409 868 | A | 7/2005 |
| WO | WO-99/11518 | A1 | 3/1999 |

*Primary Examiner* — Lars A Olsen
(74) *Attorney, Agent, or Firm* — Birch, Stewart, Kolasch & Birch, LLP

(57) ABSTRACT

A vessel (2) for handling subsea equipment comprising a subsea equipment hoist system including a winch and a hoist cable (3) for lowering and retrieving subsea equipment (5) in a hoist area of the vessel, a subsea equipment motion restraining and guidance system for restraining subsea equipment motion relative to the vessel in the hoist area. The subsea equipment motion restraining and guidance system includes a main trolley (7), an auxiliary trolley (8) and a vertical trolley guide structure (9) mounted on the hull of the vessel that allows for vertical travel of the trolleys and further a top end engagement member (10), which is movably supported by said main trolley and which is adapted to engage on a top end of the subsea equipment, and one or more rail engaging members (3*a*) mounted on said auxiliary trolley, each adapted to engage on a vertical rail (11) mounted on said subsea equipment as said subsea equipment passes vertically by said auxiliary trolley.

24 Claims, 10 Drawing Sheets

VESSEL COMPRISING A SUBSEA EQUIPMENT MOTION RESTRAINING AND GUIDANCE SYSTEM

Figure 1A:
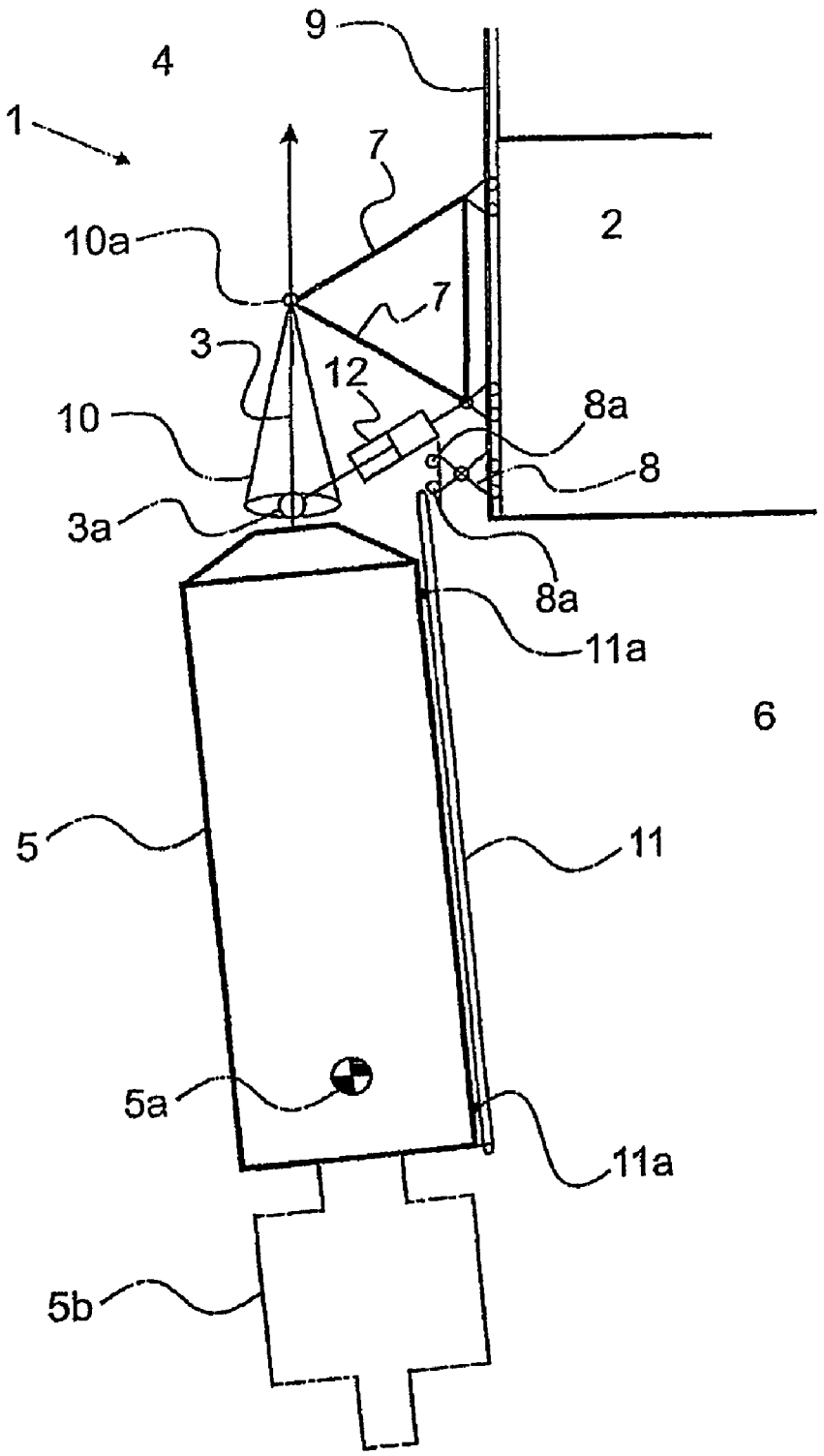

The present invention relates to a vessel, preferably a monohull vessel, for handling subsea equipment, in particular for use in the offshore industry. The vessel comprises a hull and a subsea equipment hoist system including a winch and a hoist cable for lowering and retrieving subsea equipment in a hoist area of the vessel. The vessel further comprises a subsea equipment motion restraining and guidance system for restraining subsea equipment motion relative to the vessel in the hoist area as the subsea equipment is lowered into the sea and retrieved from the sea. The subsea equipment motion restraining and guidance system includes a main trolley, an auxiliary trolley, and a vertical trolley guide structure mounted on the hull of the vessel that allows for vertical travel of the main trolley and the auxiliary trolley.

Such a vessel is known e.g. from U.S. Pat. No. 6,871,609 from the applicant. In this patent a vessel. for use in offshore industry is described. A tower and an equipment handling system are mounted on the vessel. The tower comprises a hoist system and a main and auxiliary trolley. The use of such a vessel is extensively described in the introduction part of U.S. Pat. No. 6,871,609.

The aim of the invention is to provide a vessel with a subsea equipment motion restraining and guidance system capable of more adequately avoiding collisions between the vessel and the subsea equipment.

This aim is achieved by providing the subsea equipment motion restraining and guidance system with a top end engagement member, which is movably supported by said main trolley and which is adapted to engage on a top end of the subsea equipment, and one or more rail engaging members mounted on said auxiliary trolley, each adapted to engage on a vertical rail mounted on said subsea equipment as said subsea equipment passes vertically by said auxiliary trolley. By the combination of a top end engagement member and one or more rail engaging members the subsea equipment can firmly be engaged during lowering and retrieving, avoiding any collision between the vessel and the subsea equipment.

Figure 1B:
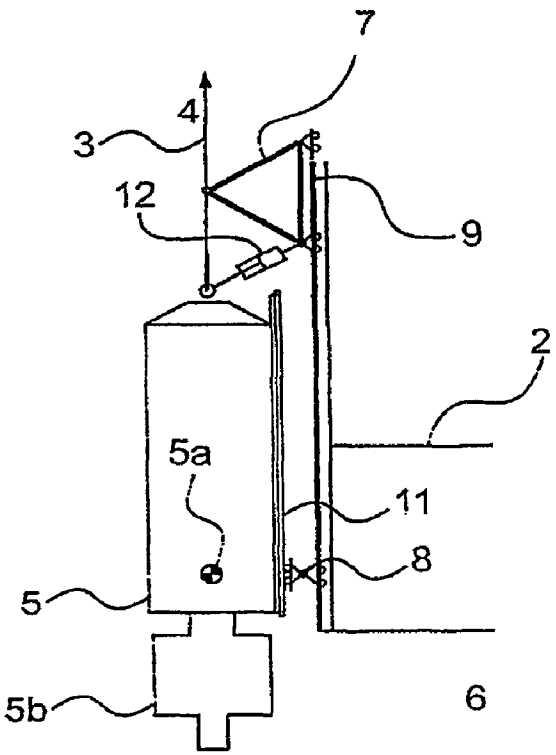
Figure 1C:
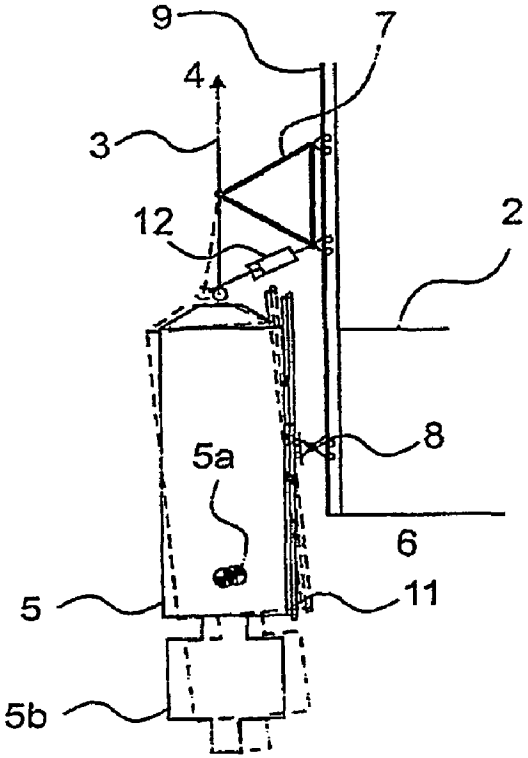
Figure 1D:
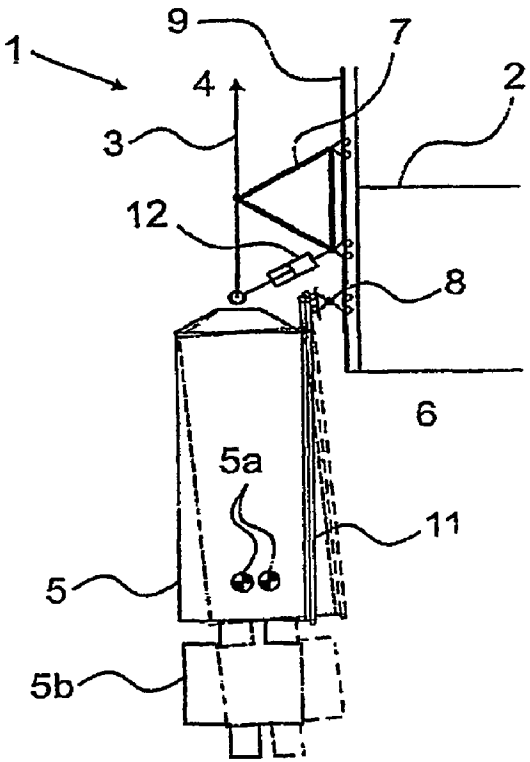
Figure 2A:
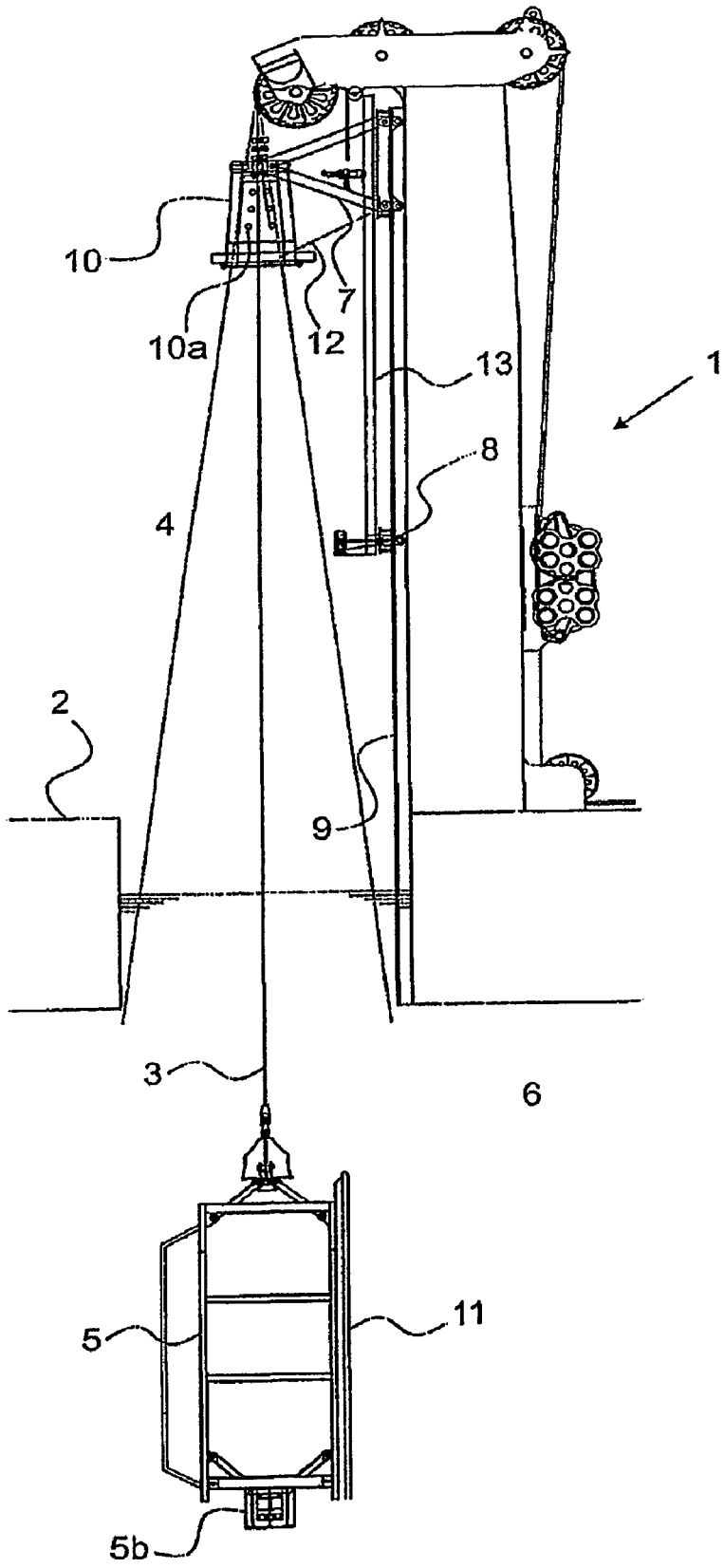
Figure 2B:
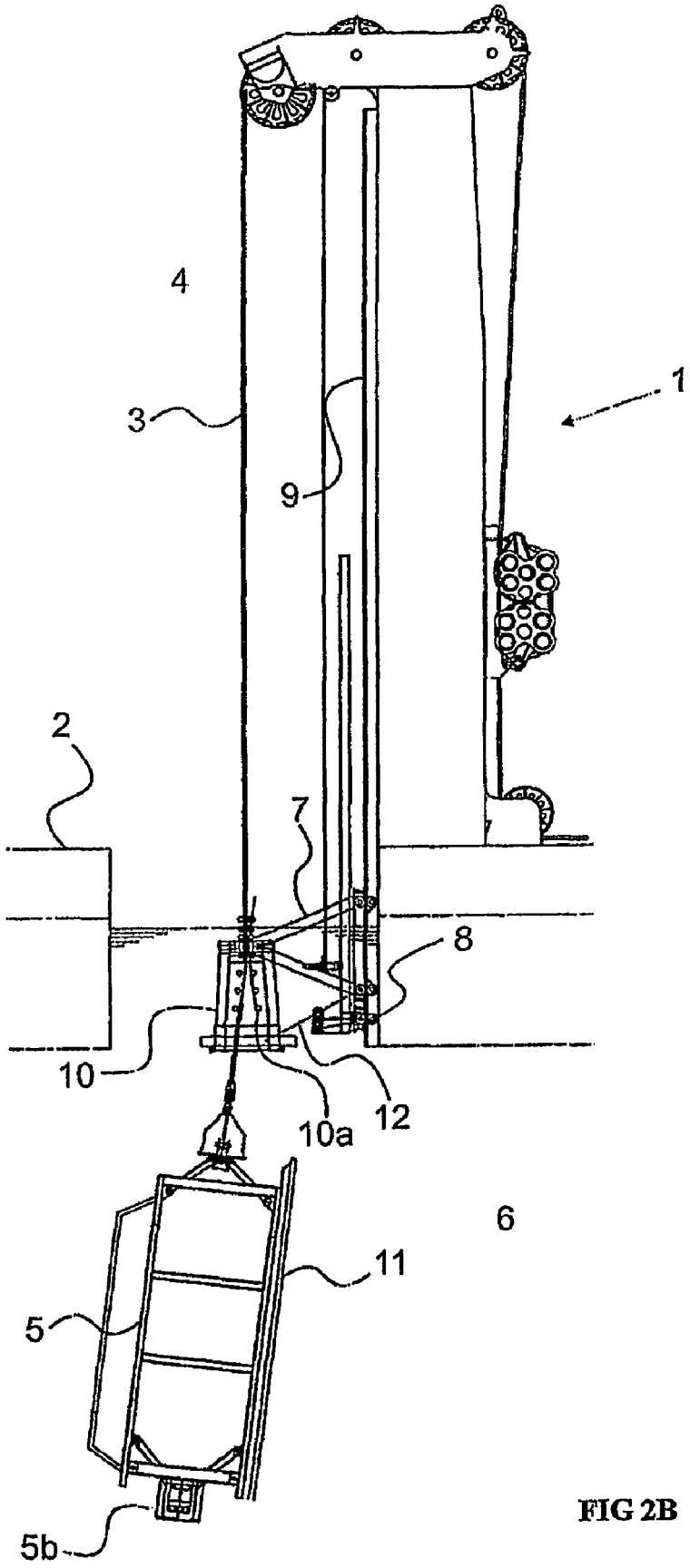
Figure 2C:
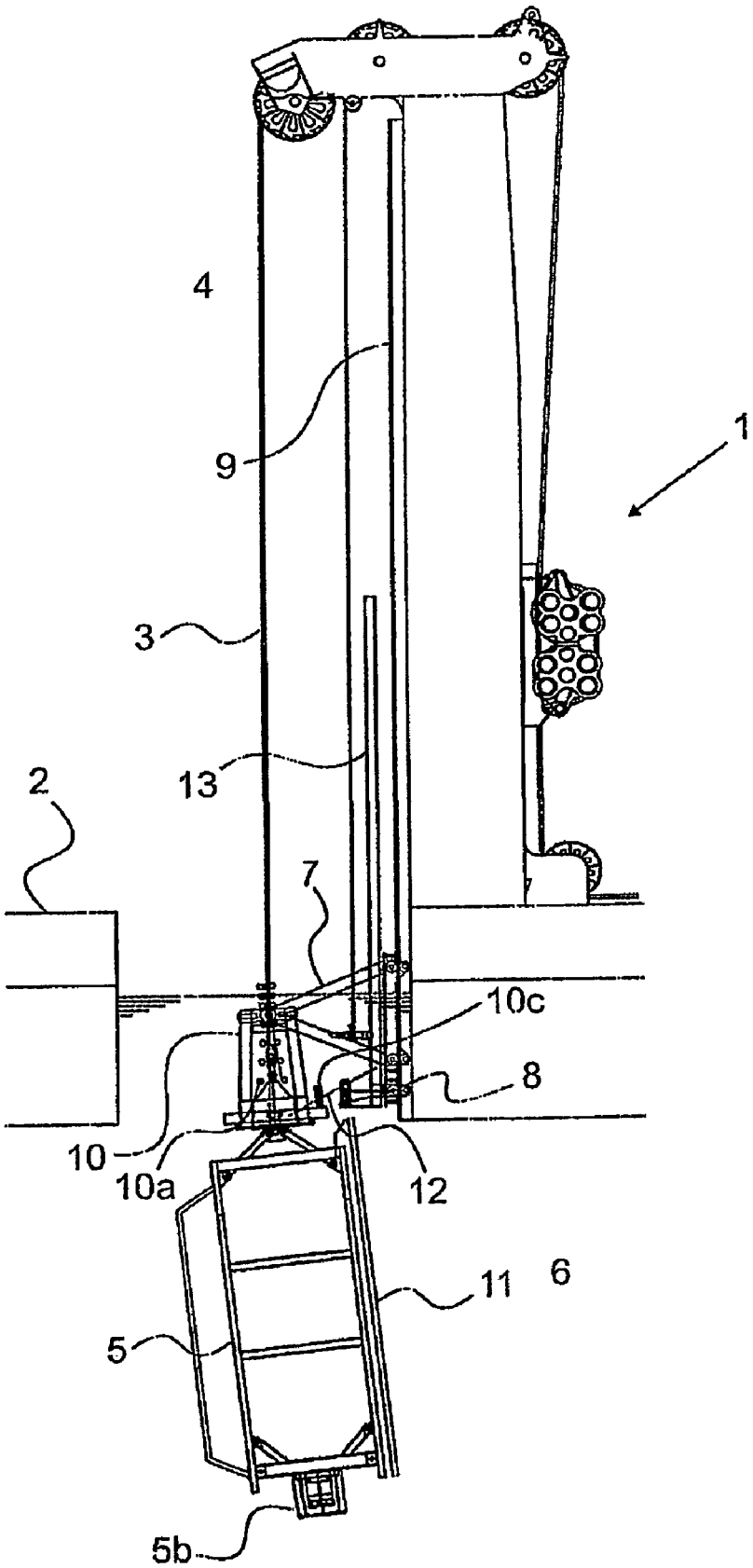
Figure 2D:
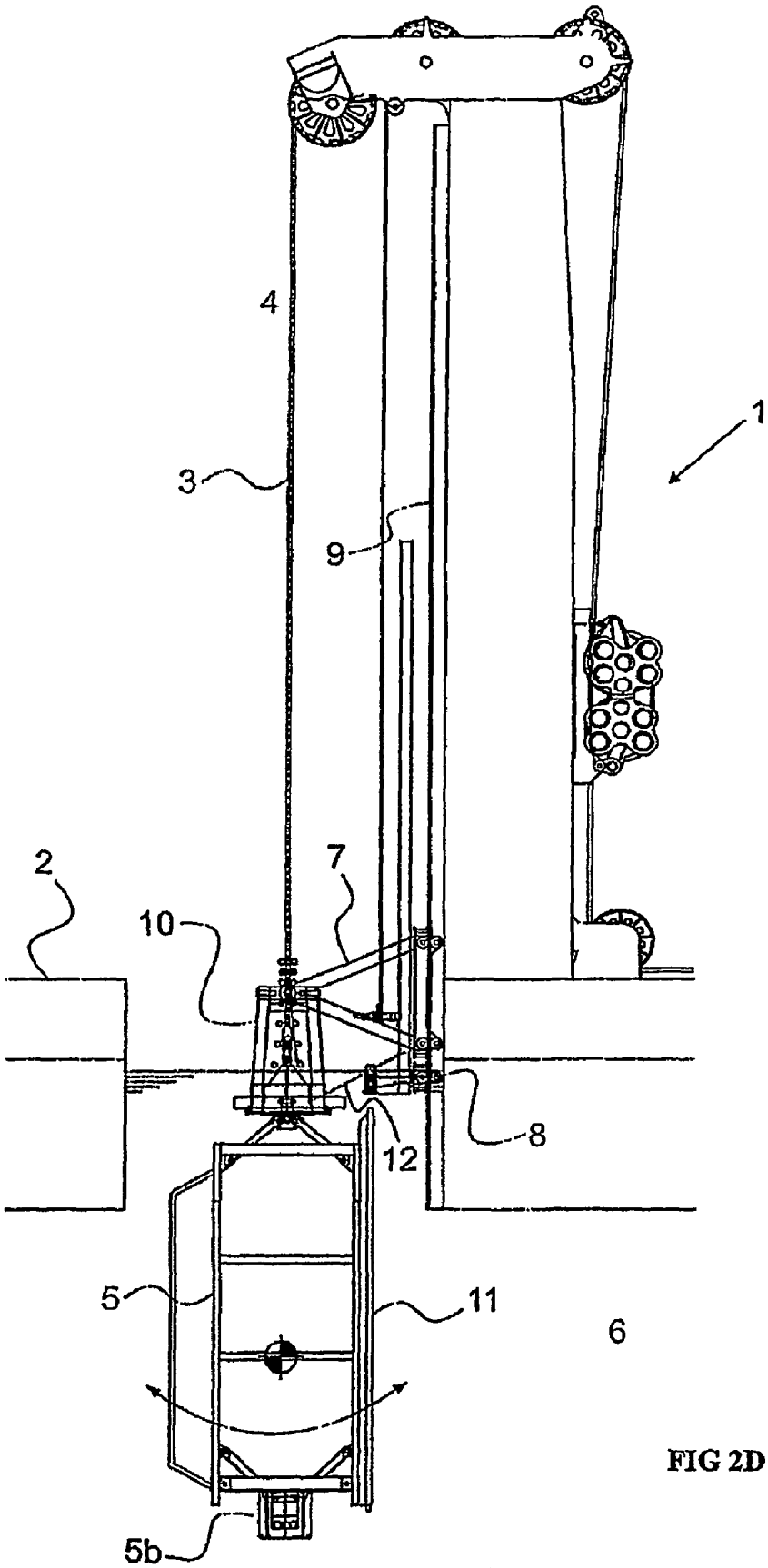
Figure 2E:
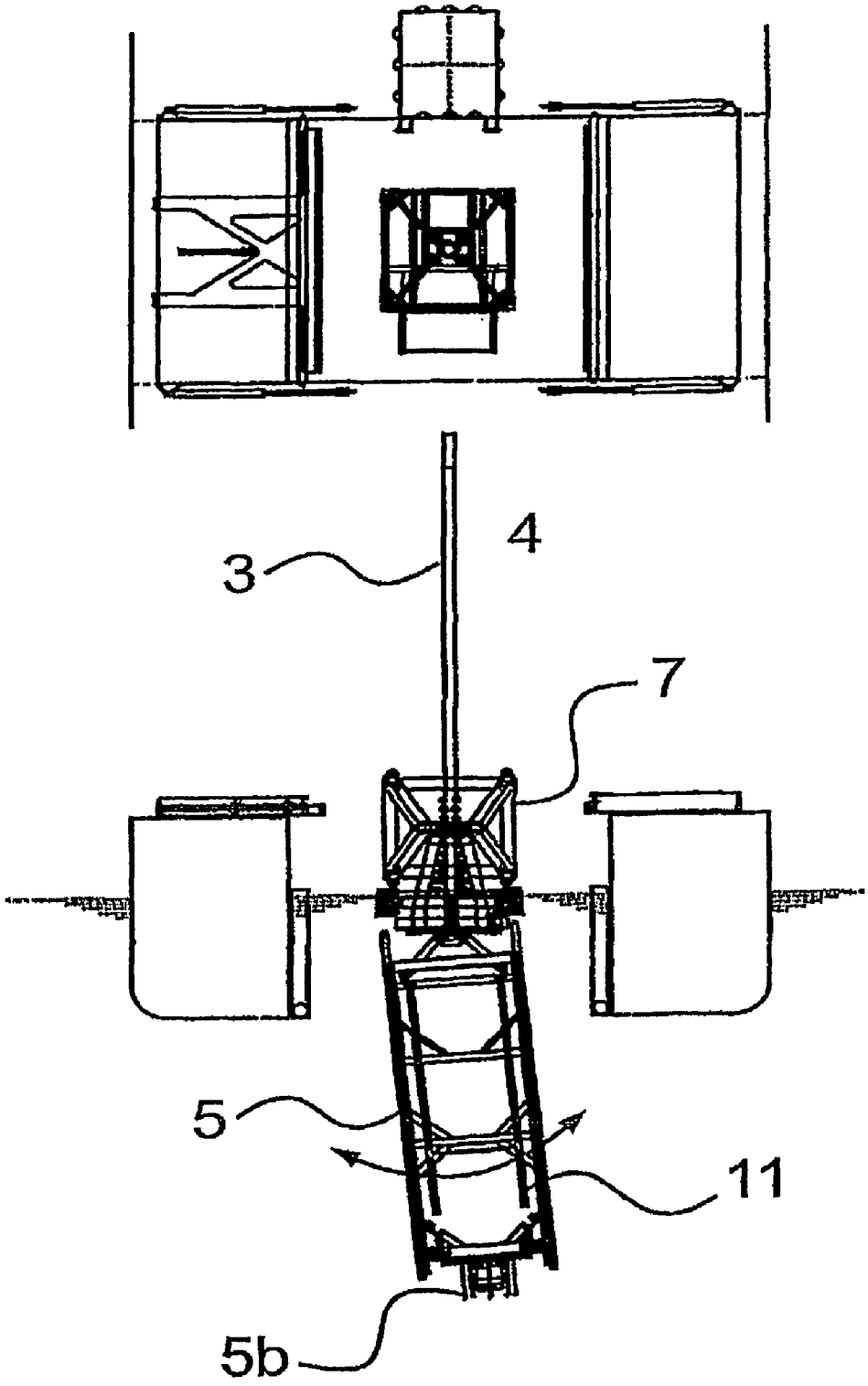
Figure 2F:
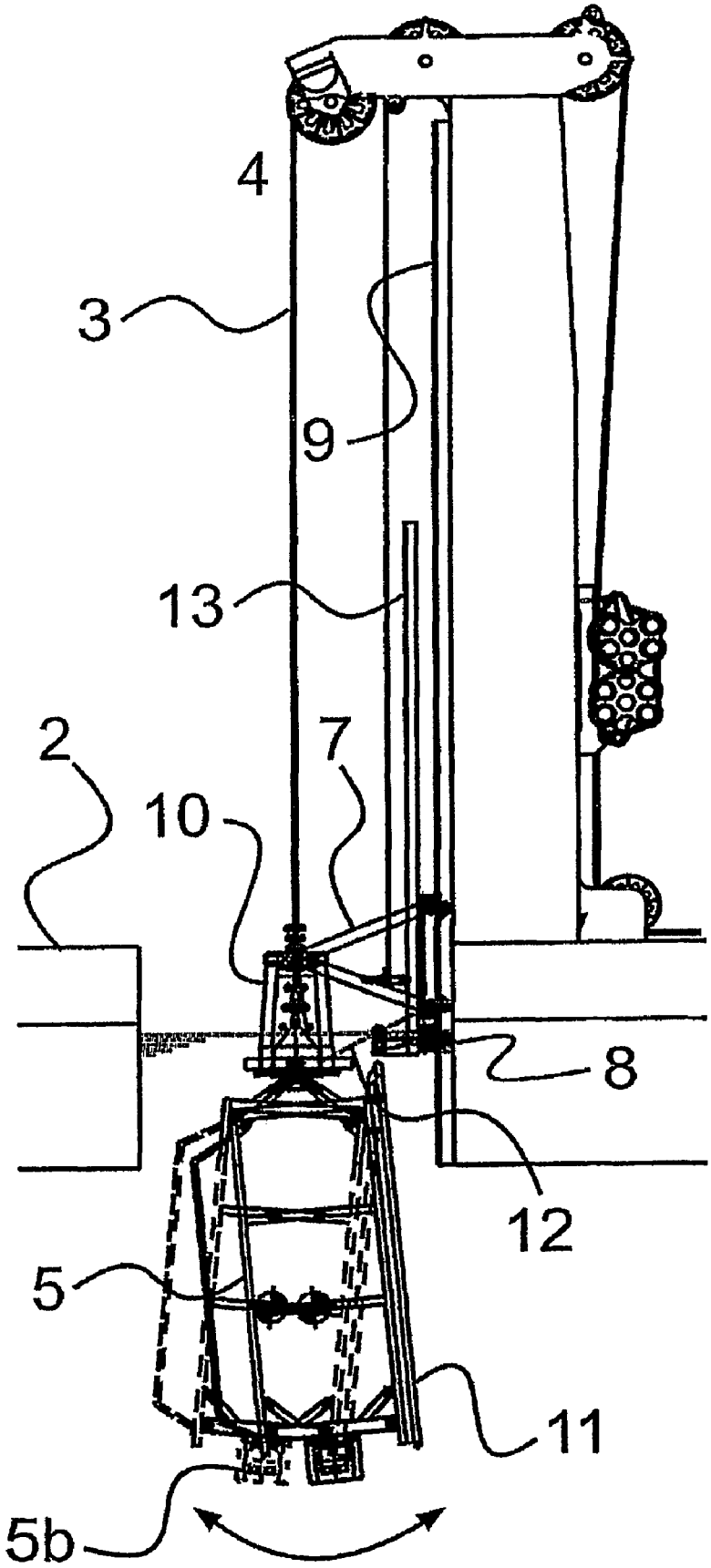
Figure 3:
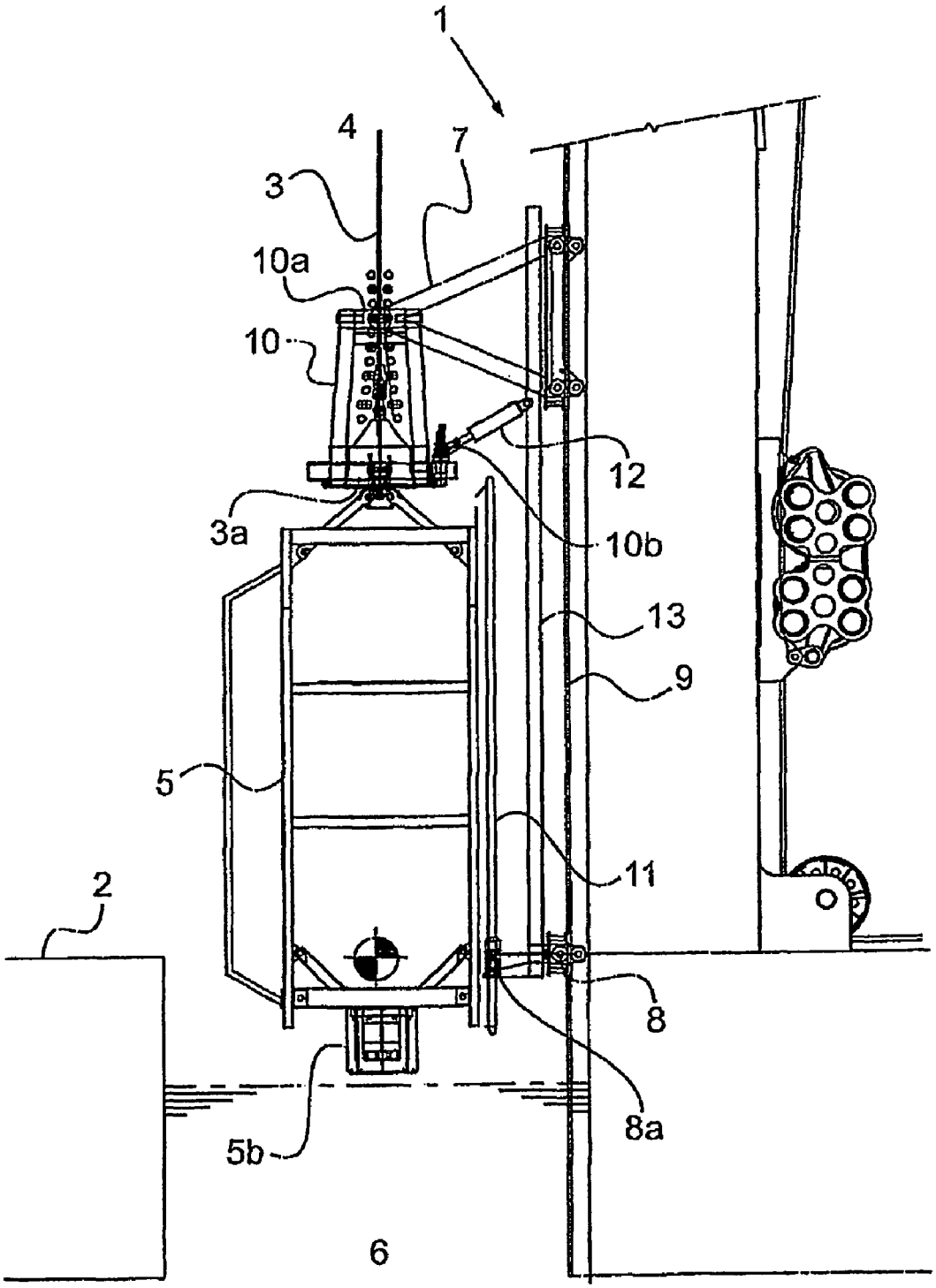
Figure 4:
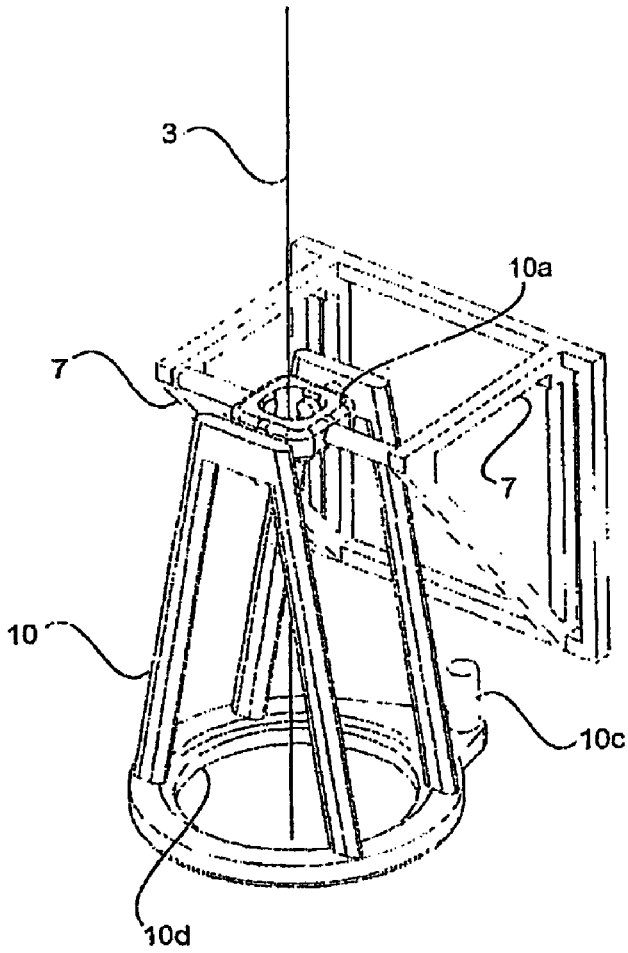
Figure 5:
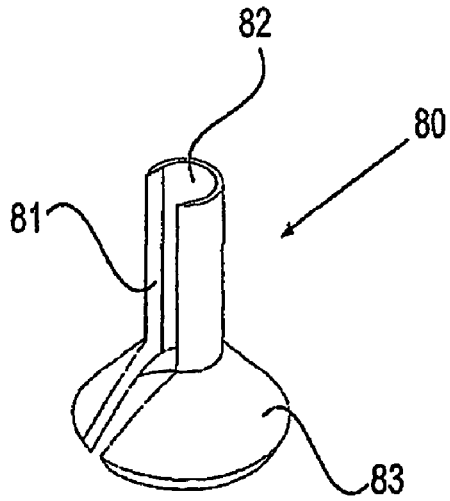

The invention will now be explained in further detail referring to the drawings, showing non-limitative examples. In the drawings:

FIGS. 1*a*-1*d* show a first schematic presentation of the operation of a preferred embodiment of a subsea equipment motion restraining and guidance system mounted on a vessel according to the invention in cross section, FIGS. 2*a*-2*f* show a second schematic presentation of the operation of the preferred embodiment of a subsea equipment motion restraining and guidance system mounted on a vessel according to the invention in cross section, FIG. 3 shows a cross section of a of the preferred embodiment of a subsea equipment motion restraining and guidance system mounted on a vessel according to the invention FIG. 4 shows schematically a first embodiment of a main trolley FIG. 5 shows schematically a first embodiment of a rail engaging member.

FIGS. 1-3 show a preferred embodiment of a subsea equipment motion restraining and guidance system mounted on a vessel according to the invention. Same parts are indicated with same numbers.

In FIGS. 1-3 a small part of a vessel 1 is shown. Part of a hull 2 is visible, as well as a part of a hoist cable 3 for lowering and retrieving subsea equipment 5. This hoist cable 3 is part of a subsea equipment hoist system further comprising a winch (not shown) for lowering and retrieving subsea equipment in a hoist area generally indicated with number 4. The hoist area 4 can be a moonpool located in the middle of the ship, but can also be located at the side or at the stern of the ship. The hoist cable 3 has a connector 3*a* for connecting to the subsea equipment 5 at a single pivotable connection point. In another embodiment, not shown, it is also possible to use two or more hoisting cables connected to the subsea equipment 5. In yet another embodiment, also not shown, it is possible to use two or even more hoisting cables connected to the subsea equipment 5 close to each other, thereby acting as being connected at a single pivotable connection point.

Subsea equipment 5 can be any equipment used in the offshore oil and gas industry. For instance the equipment can be well intervention equipment comprising tooling for bore holes, or production equipment to be placed on the seafloor. The equipment could also be e.g. an ROV, stack, template, a Christmas tree etc.

It is also envisaged that a rail assembly is used to which another subsea equipment is connected, e.g. to the lower end of the rail assembly. In FIGS. 2 and 3 connecting means 5*b* are shown at the lower end of subsea equipment 5, capable of connecting the subsea equipment 5 to any desired subsea part. The rail assembly preferably has one or more rails engagable with the auxiliary trolley by the rail engaging members.

The vessel further comprises a subsea equipment motion restraining and guidance system for restraining subsea equipment 5 motion relative to the vessel 1 in the hoist area 4 as the subsea equipment 5 is lowered into the sea and retrieved from the sea 6. The subsea equipment motion restraining and guidance system includes a main trolley 7 and an auxiliary trolley 8. Further the system comprises a vertical trolley guide structure 9 mounted on the hull 2 of the vessel 1 that allows for vertical travel of the main trolley 7 and the auxiliary trolley 8, wherein at least said auxiliary trolley can be lowered to a submerged position.

In this embodiment, main trolley 7 is composed of a rigid triangular bar construction of which two corners are connected to the trolley guide structure 9 and the other corner to a top end engagement member 10.

The subsea equipment motion restraining and guidance system further comprises a top end engagement member 10, which is movably supported by said main trolley 7 and which is adapted to engage on a top end of the subsea equipment 5. Hoist cable 3 can pass through this top end engagement member 10, and through the main trolley 7 to which this top end engagement member 10 is connected. Preferably, a guide member 10*a* is provided through which hoist cable 3 passes. In the shown embodiment, top end engagement member 10 has a pendulum support pivotably connected to main trolley 7 allowing pivotal motion in all directions with respect to the main trolley 7.

The top end engagement member 10 is provided with locking means 10*b* to lock the top end of the subsea equipment 5, once it is engaged in an engaging ring 10*d* of the top end engagement member 10. The locking means 10*b* can prevent rotation of the subsea equipment 5 in the top end engaging means, and, more important, allow for a firm connection between the subsea equipment 5 and the top end engagement member 10. The locking means 10*b* can for example be hydraulically operable locking means. More preferably, top end engagement member 10 is provided with a drive mechanism 10*c* for rotating the engaged subsea equipment 5 about a vertical rotation axis in order to align the subsea equipment 5 with the auxiliary trolley 8, more in particular to align a vertical rail 11 with rail engagement members 8*a* (see below).

Drive mechanism 10*c* can for example be a motor, preferably a hydraulically operable motor. This drive mechanism 10*c* can also act as a locking mechanism. FIG. 4 shows the top engagement member 10 and the main trolley 7 in detail.

Damper means 12 are provided between the top end engagement member 10 and the main trolley 7, that allow for dampen motion of said top end engagement member 10. When the top end engagement member 10 is engaged to the top end of the subsea equipment 5, this damper means 12 dampen the motion of the subsea equipment 5 relatively to the vessel. In the shown embodiment damper means 12 comprise hydraulic jacks, but any other damping means such as a spring or any pneumatics are also possible. In FIGS. 1-3, only one hydraulic jack 12 is shown. Preferably, two hydraulic jacks are mounted between the top end engagement member 10 and the main trolley 7. The hydraulic jacks can be placed in the shape of a horizontally orientated 'V', of which the top end is connected to the main trolley 7 and the ends to two spaced apart connecting points at the top end engagement member 10. In the shown embodiment, the hydraulic jacks are connected to an associated hydraulic circuit (not shown) having a dampened motion mode, wherein the hydraulic jack piston is free to change length while the motion is dampened and a locking mode, wherein piston motion is blocked. This occurs e.g. by throttling the displacement of hydraulic fluid between the chambers of the hydraulic jack (not shown). Possibly, the hydraulic circuit is also connected to hydraulic drive and locking means 10*c* of the top end engagement member 10 and can thereby also operate driving means 10*c*.

When damper means 12 act as locking means the position of said top end engagement member 10 is locked. When locked, the top end engagement member 10 is no longer movably supported by said main trolley 7, thereby preventing any collision between the subsea equipment 5 and the hull 2 of the vessel 1.

The system further comprises two spaced apart parallel rail engaging members 8*a*, one of which is visible in FIG. 1, mounted on said auxiliary trolley 8. Each of the rail engaging members 8*a* is adapted to engage on one of two equally spaced parallel vertical rails 11 mounted on said subsea equipment 5 as said subsea equipment 5 passes vertically by said auxiliary trolley 8. Rails 11 could be any rail type, square or round, also including recesses, cables etc. In FIG. 5, a preferred embodiment of a rail engaging member 80 is shown. Rail engagement member 80 is shaped as a slotted annular member having a slot 81 allowing the passage of connecting members 11*a* arranged between the vertical rail and the subsea equipment 5 and a hollow 82 for receiving the rail. The engaging member 80 has a funnel 83 at the lower end thereof to simplify receiving the rail 11.

Preferably, these rail engaging members 8*a* are movably mounted on the auxiliary trolley 8, and more preferably they are pivotably mounted. Arresting means (not shown) are provided that allow for arresting the auxiliary trolley 8 in a submerged position thereof to the vertical trolley guide structure 9. When the subsea equipment 5 is retrieved from the sea 6, it is possible at some point to release the auxiliary trolley 8 from its lowered position allowing the subsea equipment 5 to be retrieved further.

By allowing the rail engaging members 8*a* to pivot, it is possible that one of the rail engaging members 8*a* engages on a vertical rail 11 first, followed by the engagement of the second vertical rail 11 by the second rail. engaging member 8*a*. Additionally, pivotably mounted rail engaging members 8*a* enable the subsea equipment 5 to move in a controlled manner. When subsea equipment 5 is connected to the top end engagement member 10 dampened motion is allowed by damping means 12. By connecting the subsea equipment 5 to the auxiliary trolley 8 by two pivotable rail engaging members 8*a*, the motion of the subsea equipment 5 is restricted. Preferably, it can pivot about a first axis between the two rail engaging members 8*a*. More preferably, by allowing the rail engaging members 8*a* to pivot about a horizontal axis perpendicular to this first axis, the subsea equipment 5 can additionally tilt about a second horizontal axis between the rail engaging members 8*a* perpendicular to the first axis. Finally, by allowing the rail engaging members 8*a* to pivot about a vertical axis, it is possible to allow in a particular embodiment a limited rotation of the subsea equipment 5. This rotation is limited in that the rail engagement members 8*a* keep connected to rails 11 on the subsea equipment 5.

FIGS. 1*a*-1*d* and 2*a*-2*g* show the operation of the vessel comprising a subsea equipment according to the invention.

In FIGS. 1*a* and 2*a* the subsea equipment 5 is retrieved from the sea 6 by hoist cable 3 in hoist area 4. From FIG. 2*a* it is clear that the subsea equipment is free to move over a large angle. To avoid interference with the hoist wire 3, the main trolley 7 and the auxiliary trolley 8 are in teh highest possible position. In FIG. 2*b* the subsea equipment 5 is raised to just below the bottom of the hull 2 of the ship. The main trolley 7 and the auxiliary trolley are lowered. By lowering the trolleys, the freedom of movement of the subsea equipment 5 is restricted noticeably. It can be discerned that the main trolley 7 and the auxiliary trolley 8 are connected to each other by a connecting bar 13, which is moveable in the vertical direction. When the subsea equipment 5 is retrieved, and the trolleys are lowered, at some point a top end of the subsea equipment 5 is engaged by the top end engagement member 10. This is the situation shown in FIG. 2*c*. Hydraulic jacks 12 allow for a dampened motion of the subea equipment 5. Drive mechanism 10*c* rotates the engaged subsea equipment 5 about a vertical rotation axis in order to align the subsea equipment 5 with the auxiliary trolley 8, more in particular to align the vertical rail 11 with rail engagement members 8*a*.

Upon further retrieving the subsea equipment 5 from the sea 6, rails 11 on subsea equipment 5 are engaged by rail engaging members 8*a*. This is shown in FIG. 1*b* and in FIG. 2*d*. In FIGS. 1*b* and 1*c* two positions of subsea equipment 5 are schematically shown. The pivotable enganging members 8*a* allow some motion of the subsea equipment 5, as is visible in FIGS. 1*c*, 2*d*-*g*. In FIG. 1*d* the subsea equipment 5 is retrieved more by the hoist cable 3, resulting in that the centre of gravity 5*a* of the subsea equipment 5 is located above the auxiliary trolley 8. Once this centre of gravity 5*a* is at the same level as the auxiliary trolley 8, the subsea equipment 5 is fixed in two dimensions by the main trolley 7 and auxiliary trolley 8. The top end engagement member 10 can be locked with respect to the main trolley 7. Only movement in the third, vertical direction is possible by the hoist cable 3. By unlocking the arrested auxiliary trolley 8, the auxiliary trolley can move upwards together with the subsea equipment 5.

The invention claimed is:

1. A vessel for handling subsea equipment, said vessel comprising:

a hull, a subsea equipment hoist system including a winch and a hoist cable for lowering and retrieving subsea equipment in a hoist area of the vessel, and a subsea equipment motion restraining and guidance system for restraining subsea equipment motion relative to the vessel in the hoist area as the subsea equipment is lowered into the sea and retrieved from the sea, said system including:

a main trolley, an auxiliary trolley, a vertical trolley guide structure mounted on the hull of the vessel that allows for vertical travel of the main trolley and the auxiliary trolley, wherein the subsea equipment motion restraining and guidance system further comprises:

a top end engagement member, which is movably supported by said main trolley and which is adapted to engage on a top end of the subsea equipment, one or more rail engaging members mounted on said auxiliary trolley, each adapted to engage on a vertical rail mounted on said subsea equipment as said subsea equipment passes vertically by said auxiliary trolley.

2. The vessel according to claim 1, wherein the hoist cable has a connector for connecting to the subsea equipment at a single pivotable connection point.

3. The vessel according to claim 1, wherein the subsea equipment motion restraining and guidance system further comprises arresting means that allow for arresting the auxiliary trolley in a submerged position thereof.

4. The vessel according to claim 1, wherein the top end engagement member has a pendulum support allowing pivotal motion in all directions with respect to the main trolley.

5. The vessel according to claim 1, wherein damper means are provided between the top end engagement member and the main trolley that allow for dampening motion of said top end engagement member and any subsea equipment engaged therewith.

6. The vessel according to claim 1, wherein locking means are provided between the top end engagement member and the main trolley that allow for locking the position of said top end engagement member.

7. The vessel according to claim 1, wherein one or more hydraulic jacks are arranged between the top end engagement member and the main trolley.

8. The vessel according to claim 7, wherein the one or more hydraulic jacks are connected to an associated hydraulic circuit having a dampened motion mode, wherein a hydraulic jack piston is free to change length while the motion is dampened and a locking mode, wherein piston motion is locked.

9. The vessel according to claim 1, wherein said one or more rail engaging members are movably mounted on said auxiliary trolley.

10. The vessel according to claim 1, wherein said one or more rail engaging members are pivotably mounted.

11. The vessel according to claim 1, wherein a rail engaging member is an annular member in which the rail slides as the subsea equipment is lowered or retrieved.

12. The vessel according to claim 1, wherein a rail engaging member is a slotted annular member having a slot allowing the passage of a connecting member arranged between the vertical rail and the subsea equipment.

13. The vessel according to claim 1, wherein two spaced apart parallel rail engaging members are mounted on said auxiliary trolley, each for receiving one of two equally spaced parallel rails mounted on said subsea equipment.

14. The vessel according to claim 1, wherein the main trolley comprises guide members through which the hoist cable passes.

15. The vessel according to claim 1, wherein the top end engagement member is provided with a drive mechanism for rotating engaged subsea equipment about a vertical rotation axis in order to align the vertical rail with the rail engagement members.

16. A rail assembly including one or more essentially vertical rails mountable on subsea equipment for use with a vessel according to claim 1.

17. The rail assembly according to claim 16, having a lower end connector for connecting to the subsea equipment.

18. Subsea equipment for use with a vessel according to claim 1 having one or more essentially vertical rails.

19. A subsea equipment motion restraining and guidance system according to claim 1.

20. A method of lowering and retrieving subsea equipment wherein use is made of a vessel according to claim 1.

21. The vessel according to claim 1, wherein the vessel is a monohull vessel.

22. The vessel according to claim 8, wherein the hydraulic jack piston is free to change length while the motion is dampened by throttling a displacement of hydraulic fluid between chambers of the hydraulic jack.

23. The vessel according to claim 10, wherein said one or more rail engaging members are pivotably mounted about a horizontal pivot axis.

24. The vessel according to claim 11, wherein the annular member is a cylinder having a funnel at the lower end thereof.

* * * * *